US007849928B2

(12) United States Patent
Collie

(10) Patent No.: US 7,849,928 B2
(45) Date of Patent: Dec. 14, 2010

(54) SYSTEM AND METHOD FOR SUPPORTING POWER CABLE IN DOWNHOLE TUBING

(75) Inventor: Charles C. Collie, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 195 days.

(21) Appl. No.: 12/139,206

(22) Filed: Jun. 13, 2008

(65) Prior Publication Data

US 2009/0308618 A1 Dec. 17, 2009

(51) Int. Cl.
*E21B 23/00* (2006.01)
*F16L 3/00* (2006.01)

(52) U.S. Cl. ..... 166/378; 166/214; 166/242.2; 166/382; 166/385; 138/108; 138/112

(58) Field of Classification Search ..... 166/385, 166/342.2, 214, 242.2, 378, 382; 138/108, 138/111–114
See application file for complete search history.

(56) References Cited

U.S. PATENT DOCUMENTS 1,891,615 A 12/1932 Bostic
2,018,477 A 10/1935 Wentz
2,035,274 A * 3/1936 Mougey ..... 174/29
2,420,712 A * 5/1947 Mample ..... 174/28
2,510,358 A 6/1950 Wolf
2,556,244 A * 6/1951 Weston ..... 174/29
2,915,089 A 12/1959 Horsting, Sr.
3,227,800 A * 1/1966 Bondon ..... 174/29
3,750,058 A * 7/1973 Bankert et al. ..... 333/242
3,758,701 A * 9/1973 Schmidt ..... 174/28
4,098,476 A * 7/1978 Jutte et al. ..... 248/694
5,262,593 A * 11/1993 Madry et al. ..... 174/102 R
5,269,377 A * 12/1993 Martin ..... 166/385
5,435,351 A * 7/1995 Head ..... 138/111
5,699,996 A * 12/1997 Boyle et al. ..... 254/134.4
5,742,002 A * 4/1998 Arredondo et al. ..... 174/29
5,821,452 A 10/1998 Neuroth et al.
5,954,136 A * 9/1999 McHugh et al. ..... 166/384
5,988,286 A * 11/1999 Dwiggins ..... 166/382
5,992,468 A * 11/1999 Dwiggins ..... 138/108
6,065,540 A * 5/2000 Thomeer et al. ..... 166/297
6,143,988 A 11/2000 Neuroth et al.
6,148,925 A * 11/2000 Moore ..... 166/384
6,167,915 B1 1/2001 Collie et al.
6,179,269 B1 1/2001 Kobylinski
6,323,420 B1 * 11/2001 Head ..... 174/47
6,479,752 B1 11/2002 Neuroth et al.
7,073,602 B2 7/2006 Simpson et al.

(Continued)

FOREIGN PATENT DOCUMENTS

EP 893573 A2 * 1/1999

(Continued)

*Primary Examiner*—Jennifer H Gay
(74) *Attorney, Agent, or Firm*—Bracewell & Giuliani LLP

(57) ABSTRACT

ESP power cable is inserted into a length of tubing disposed in a wellbore. The device comprises a support attachable to the cable that is in frictional sliding contact with the tubing inner surface. The frictional sliding contact between the support and the tubing reduces axial stress in the cable. Support devices are added at intervals on the cable length, thereby distributing the cable axial stress along the cable.

20 Claims, 5 Drawing Sheets

U.S. PATENT DOCUMENTS

| | | | | |
|---|---|---|---|---|
| 7,152,685 | B2 * | 12/2006 | Adnan et al. | 166/380 |
| 7,670,451 | B2 * | 3/2010 | Head | 156/293 |
| 2005/0045343 | A1 | 3/2005 | Bixenman et al. | |
| 2008/0264651 | A1 * | 10/2008 | Ali et al. | 166/385 |
| 2009/0308618 | A1 * | 12/2009 | Collie | 166/385 |
| 2010/0078179 | A1 * | 4/2010 | Mack | 166/380 |
| 2010/0096124 | A1 * | 4/2010 | Naumann | 166/250.01 |
| 2010/0096144 | A1 * | 4/2010 | Mack | 166/382 |

FOREIGN PATENT DOCUMENTS

| | | | |
|---|---|---|---|
| GB | 2326536 A | * | 12/1998 |
| WO | WO 9951851 A1 | * | 10/1999 |

* cited by examiner

SYSTEM AND METHOD FOR SUPPORTING POWER CABLE IN DOWNHOLE TUBING

FIELD OF THE INVENTION

This invention relates in general to supporting a power cable within downhole tubing, and in particular to a method and device enabling installation of an electrical power cable into tubing disposed within a wellbore.

BACKGROUND OF THE INVENTION

Electrical submersible pumps (ESP) are normally installed on the bottom end of jointed production tubing within a cased wellbore and powered by a power cable typically attached to the outside of production tubing. In this configuration, an annulus is formed between the tubing and the wellbore casing and the produced fluids are pumped up the production tubing to the surface.

Oil well completions are being developed to deploy ESPs on the bottom of continuous coiled tubing where the power cable is placed inside the coiled tubing. In these installations, produced fluids are pumped up the annulus between the coiled tubing and the production tubing, or well casing or liner. Many advantages are gained through the use of coiled tubing such as faster deployment, the elimination of a need for large workover rigs, and less frictional pumping losses.

ESP cable has limited yield strength and will break if too long a length of cable is suspended from a support point. Thus when assembling the ESP cable within coiled tubing, the cable is drawn through the coiled tubing on a line while the coiled tubing is horizontally oriented—which is a time consuming effort. Because ESP cable cannot support its total vertical weight, cable support must be provided by the coiled tubing at regular intervals. Various proposals have been made to provide support, such as the use of mechanical anchors. A need exists for anchors which can be used in fairly small diameter coiled tubing, which will accommodate movement associated with thermal expansion and which will accommodate bending of coiled tubing.

SUMMARY OF THE INVENTION

Disclosed herein is a method of assembling a power cable with downwardly oriented borehole tubing. In one embodiment the method involves suspending a length of power cable from a hanging point into the downwardly oriented borehole tubing. The length of power cable forms an axial stress in the power cable proximate to the hanging point. The method may further include distributing a portion of the axial stress to a section of power cable suspended in the tubing by attaching a first support to the power cable, and lowering the power cable with attached first support into the borehole tubing, wherein the first support is configured to be in sliding frictional contact with the borehole tubing inner surface while being lowered into the tubing. Additional supports may be added to the power cable after the cable is inserted an interval from the hanging point. This process can be repeated until a certain length of power cable is inserted into the tubing. The interval may be constant or may vary. The axial stress in the power cable can be maintained from about 25% to about 75% of the power cable yield stress. Additionally, the method may further include retrieving the assembly of borehole tubing with inserted power cable from the borehole and spooling the tubing with inserted cable onto a first reel. The assembly may then optionally be transferred from the first reel to a second reel. An ESP can be attached to an end of the assembly, the attached end can either be the end that was in the bottom of the borehole during assembly, or the top end after the cable has been inverted with the second reel. After attaching the ESP, the ESP can be deployed into a well on the end of the assembly. The deployed well can be the same one where assembly occurred, or a different well. The supports slide relative to the tubing while the cable is being inserted and do not slide relative to the tubing while the cable and attached supports are inverted. The well in which the ESP is inserted can be any well, for example, it can be at surface or sub-sea.

Also disclosed herein is a borehole assembly having tubing disposed in the borehole, a length of power cable suspended in the tubing, and a first suspension support mounted onto the cable in frictional sliding contact with the tubing inner surface, the suspension support in contact with the tubing inner surface along an annular area of the inner surface. Alternatively two or more suspension supports may be attached to the power cable. The power cable has a maximum hanging distance defined by the length of power cable suspended from a hanging point at which the power cable may fracture from its own suspended weight and wherein the interval value is a percentage of the maximum hanging distance. In one example, a suspension support is an annular sleeve flanged on one end and flared on the other and a spring circumscribing the sleeve, the spring slidable between the flanged end and the flared end. In another example, a suspension support is a first collar affixed around the cable, a second collar slidable and rotatable on the collar, and a split ring having a first end attached to the first collar and a second end attached to the second collar. Instead of a split ring, a spring may be substituted.

DETAILED DESCRIPTION OF THE INVENTION

Figure 1:
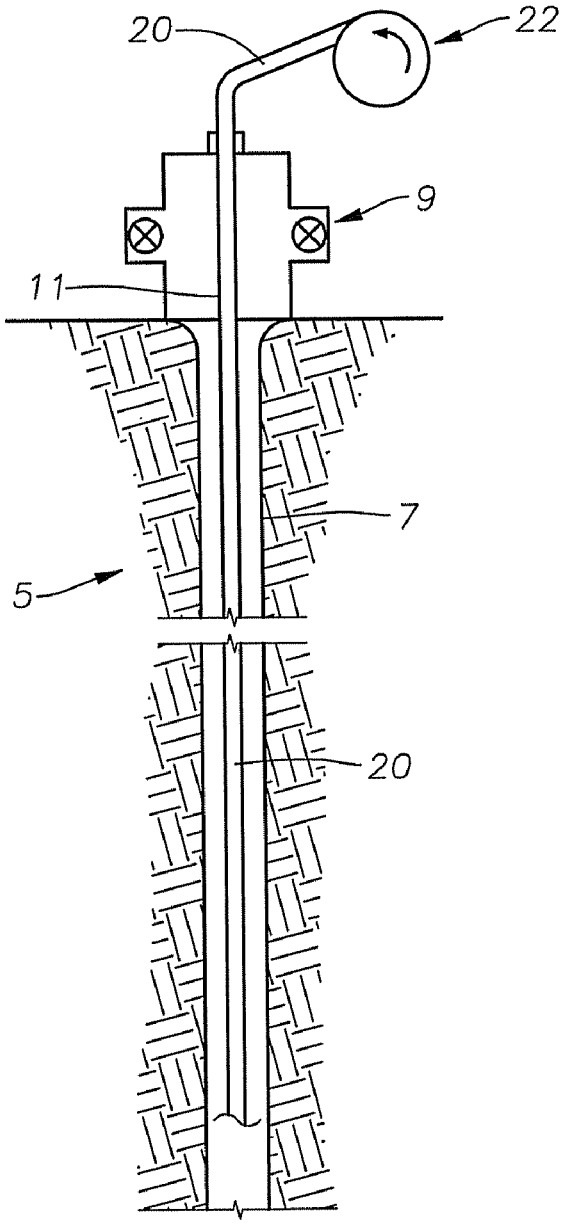
FIG. 1 is a side partial sectional view illustrating production tubing being inserted into a wellbore.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

With reference now to FIG. 1, a wellbore 5 lined with casing 7 is shown in a side partial sectional view with coiled tubing 20 shown being inserted into the casing 7. The coiled tubing 20 is inserted into the wellbore 5 through a vertically oriented bore 11 formed through a wellhead housing 9. The tubing 20 is schematically illustrated being unspooled from a reel 22 and into the opening of the bore 11. Alternatively, the coiled tubing 20 could be inserted into production tubing (not shown) suspended within the casing 7.

Figure 2:
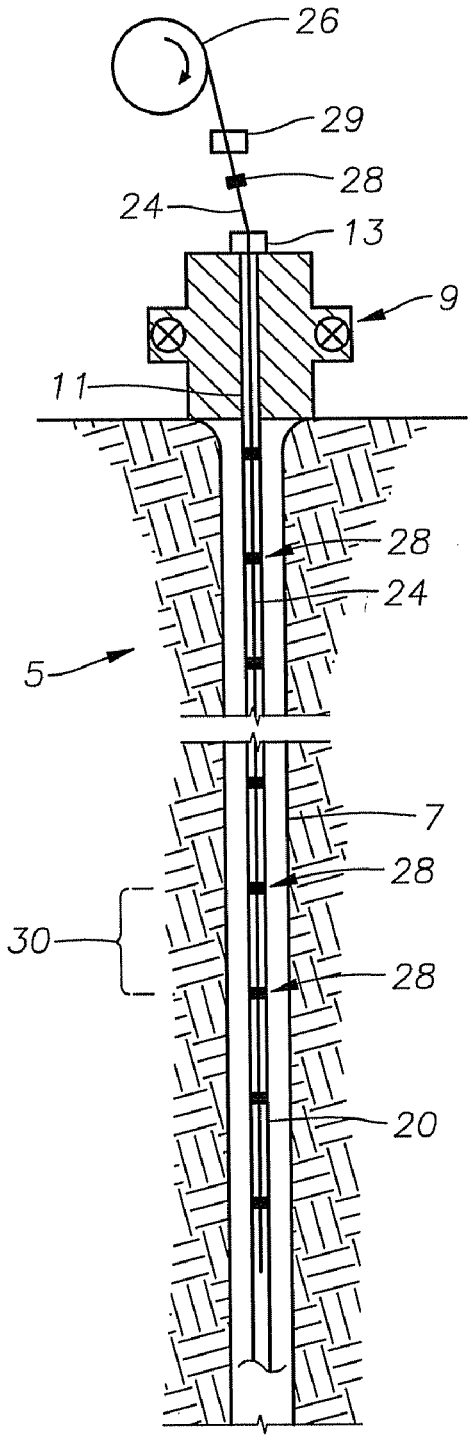
FIG. 2 is a side partial sectional view depicting an ESP power cable being inserted into the production tubing of FIG. 1.

FIG. 2 depicts in a side partial sectional view a length of power cable 24 being inserted within the tubing 20. As shown, the tubing 20 has been unspooled from the reel 22 and suspended from the wellhead housing 9 into the wellbore 5. A length of power cable 24, stored on a power cable reel 26, is shown being inserted through the bore 11 of the wellhead housing 9 and into the suspended coiled tubing 20. For the purposes of illustration, the power cable 24 passes through a hanging point 29 below the reel 26. The hanging point 29 represents a point on the power cable 24 where a force is applied that holds the power cable 24 and suspends it within the tubing 20. However, the hanging point 29 could also be where the power cable 24 is unspooled from the reel 26 or within the wellhead housing 9, such as the bore entrance 13. As noted above, the power cable 24 may break under its own weight if enough length of power cable 24 is suspended beneath a hanging point 29.

One of the novel aspects of the present disclosure involves affixing a sliding support 28 onto the outer surface of the power cable 24. The sliding support 28 outer periphery is configured for frictional sliding contact with the inner surface 21 of the tubing 20. Sliding supports 28 preferably do not slide relative to the power cable 24. Accordingly, attaching a sliding support 28 onto the power cable 24 and introducing the support 28 within the tubing 20 redistributes or transfers some of the hanging weight of the power cable 24 from the hanging point 29. The transferred hanging force is redistributed on the cable 24 where the sliding support 28 is secured. Adding multiple sliding supports 28 onto the power cable 24 before insertion into the tubing 20 distributes the cable 24 weight along a substantial portion of the cable 24 length. Accordingly, strategically positioning sliding supports 28 onto the cable 24 increases the length of the power cable 24 that may be suspended within the tubing 20 without the risk of the power cable 24 fracturing under its own suspended weight. Moreover, strategically positioning multiple sliding supports 28 onto the cable 24 allows for an unlimited length of power cable 24 to be inserted within the vertical wellbore 5 shown in FIG. 2.

In one optional embodiment, the adjacent sliding supports 28 may be separated by an interval 30, wherein the interval 30 value does not exceed the maximum hanging distance. The maximum hanging distance is the length of power cable 24 suspended from a hanging point 29 where the power cable 24 may fracture under its own weight. It is well within the capabilities of one skilled in the art to determine the maximum hanging length of the power cable 24. Knowing the yield stress of the power cable 24, the cross-sectional area of the power cable 24, and the weight per unit length of the power cable 24, a maximum hanging length can be readily estimated.

The value of the interval 30 is not limited to a single value but can vary depending on many factors. Thus, the configuration shown in FIG. 2 can employ multiple sliding supports 28 affixed to the power cable 24 within the coiled tubing 20, wherein the distance between adjacent sliding supports 28 can be substantially the same, or can be varied along the cable length 24. Also illustrated in the figures, the borehole 5 is substantially vertical and downwardly oriented. For the purposes of discussion herein, downwardly oriented can include any borehole orientation wherein the borehole extends from the surface such that the power cable 24 can be suspended within the coiled tubing 20 and gravity aided for inserting the cable 24 within the coiled tubing 20.

Figure 3:
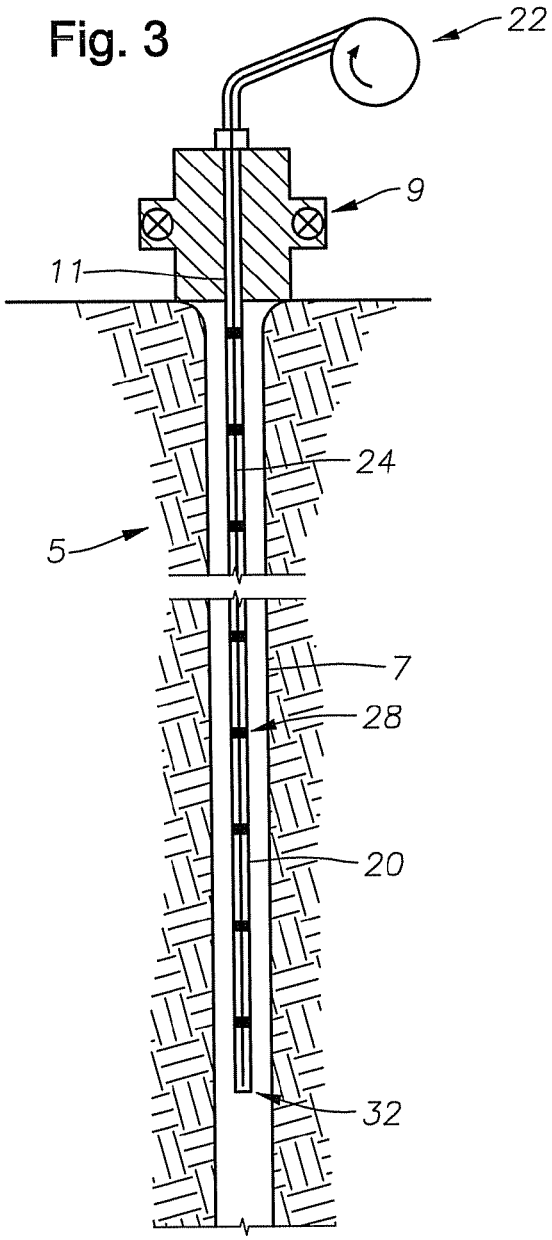
FIG. 3 is a side partial sectional view illustrating the production tubing with inserted power cable being spooled onto a reel.

FIG. 3 is a side partial sectional view illustrating the tubing 20 and power cable 24 assembly with attached sliding supports 28. In this embodiment the power cable 24 and coiled tubing 20 are roughly the same length. However, it should be pointed out that the respective lengths of the tubing 20 and the power cable 24 can differ. Provided as a reference, the lower terminal end of the tubing 20 is referred to as the tubing first end 32. Here, the combination of tubing 20 and power cable 24 is shown being taken up, or removed from the well, on a reel 22.

Figure 4:
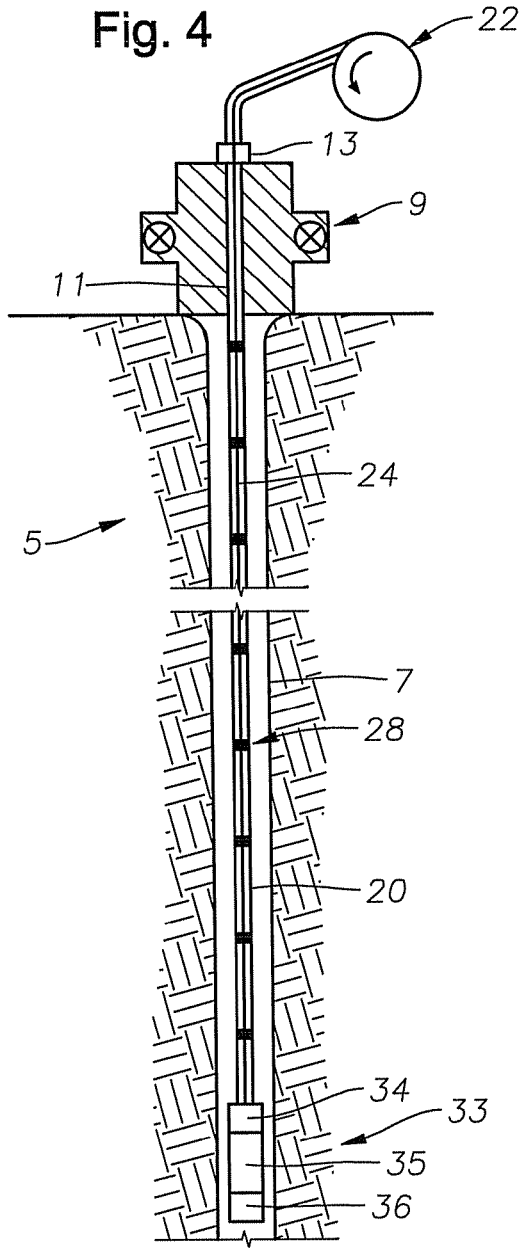
FIG. 4 is a side partial sectional view showing the producing tubing with inserted power cable having an ESP attached on its lower end being deployed into a wellbore.

FIG. 4 illustrates a side sectional view of the tubing 20 with combined power cable 24 suspended therein with sliding supports 28 being reinserted into a borehole 5. As in FIG. 1, the tubing 20 is inserted through the entrance of the bore 11 of a wellhead housing 9. However, the wellbore 5 in which the tubing 20 and power cable 24 assembly is being reinserted may be different from the one in which the tubing 20 and power cable 24 were assembled. In one embodiment of the method described herein, a staging well is used for forming the tubing 20 and power cable 24 with sliding supports 28 assembly. With reference again to FIG. 4, an ESP system 33 has been attached to the lower terminal end of the tubing 20. In this embodiment, the ESP system 33 comprises a pump motor 34, a pump 35, and an equalizer or seal section 36 on the lower end of the ESP system 33. The power cable 24 is shown attached to the pump motor 34 for providing electrical power to the pump motor 34 for running the pump 35.

Figure 5:
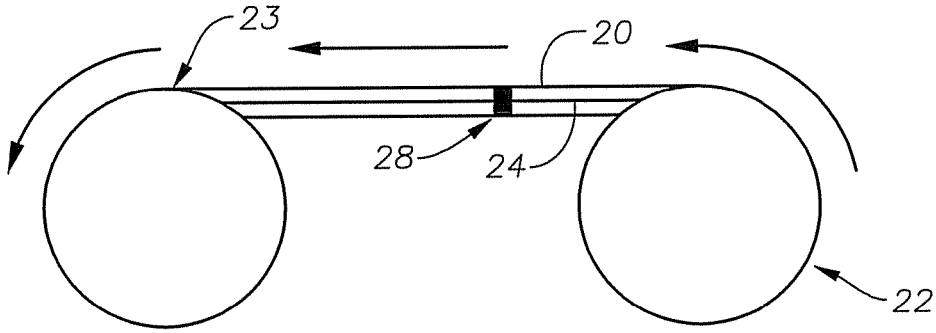
FIG. 5 is a side view of coiled tubing being spooled from one reel to another reel.

FIG. 5 provides in side view an optional step of re-spooling from a first reel to a second reel before reinserting coiled tubing 20 along with the power cable 24 into a well. In this figure, the tubing 20 and cable 24 assembly is being despooled from the first reel 22 onto a second tubing reel 23. The second reel 23 can be used in lieu of the reel 22 of FIG. 4 for deploying the tubing 20 and cable 24 assembly into the wellbore 5. By employing the optional "respooling" step, the tubing 20 and cable 24 assembly is inverted within the wellbore wherein the previously uppermost end of the tubing 20 from FIG. 2 is now attached to the ESP 33 and the tubing first end 32 is disposed on the upper end of the wellbore 5.

Figure 6:
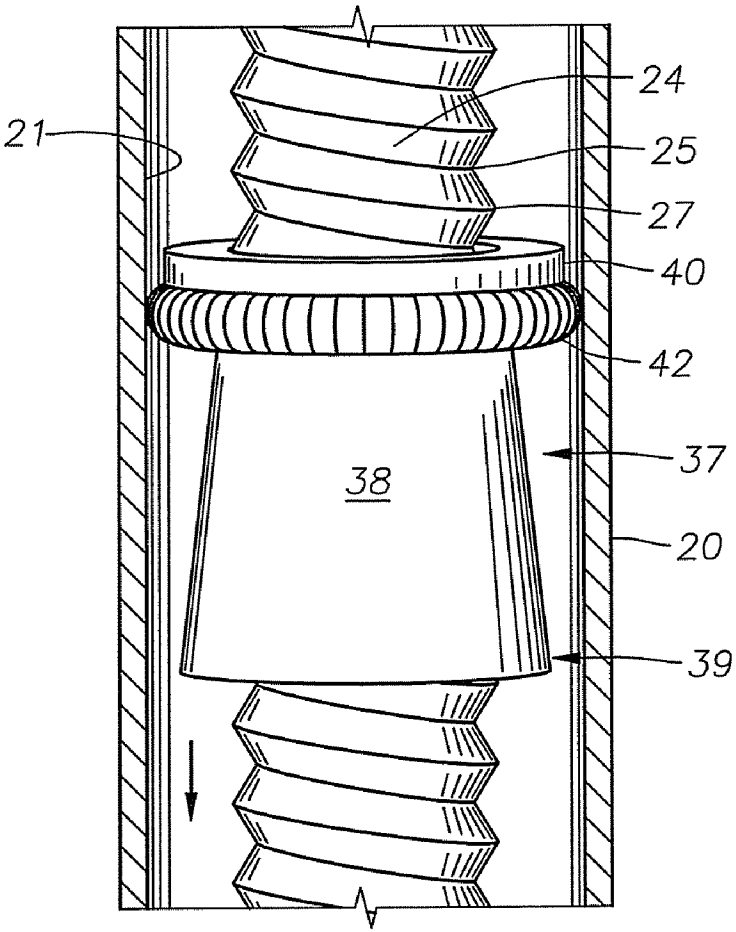
FIG. 6 is a side view of an embodiment of a cable with an attached cable support in tubing.

With reference now to FIG. 6, a side partial sectional view of an embodiment of a sliding support 37 is shown attached to a power cable 24. The power cable 24 with attached support 37 is coaxially disposed within tubing 20. In this embodiment, the power cable 24 has an undulating outer surface that comprises a series of alternating troughs 25 and peaks 27. For example, the outer surface might comprise a helical wrapped metal strip, forming an outer armor. The support 37 comprises an annular sleeve 38 through which the cable 24 is inserted. The sliding support 37 is affixed to the cable 24 at a point within the sleeve 38. Any known method of affixing the sleeve 37 to the cable 24 can be used, such as forming a sleeve having two substantially equal halves secured together with bolts (now shown) along their length to form a press fit of the sliding support 37 onto the cable 24. Moreover, the sleeve 37 annulus may have corresponding profiles matching the trough 25 and peak 27 of the power cable 24.

In the embodiment of the support 37 of FIG. 6, the sleeve has a tapered end 39 on one end and a flange 40 on the other. As shown, the cable 24 assembly is in the stage of being inserted into coiled tubing 20, therefore, the cable 24, as illustrated by the arrow, is moving downward within the tubing 20. Also, the sliding support 37 is oriented such that the tapered end 39 is on the lower end of the sliding support 37. The support 37 further comprises a coiled spring 42 that radially circumscribes the sleeve 38. The combined dimensions of the tapered annular sleeve 38 and the diameter of the coiled spring 42 are such that the individual spring elements are in sliding contact with the inner circumference 21 of the tubing 20 when the spring 42 is at flange 40. This sliding friction between the spring 42 and the inner circumference 21 provides the distributive supporting force for redistributing the hanging weight from the hanging point 29 to the sliding support 37. The presence of the flange 40 on the upper end of the sliding support 37 prevents spring 42 from rolling off of the support 37 in response to the sliding force applied by the tubing 20 inner circumference 21.

Figure 7:
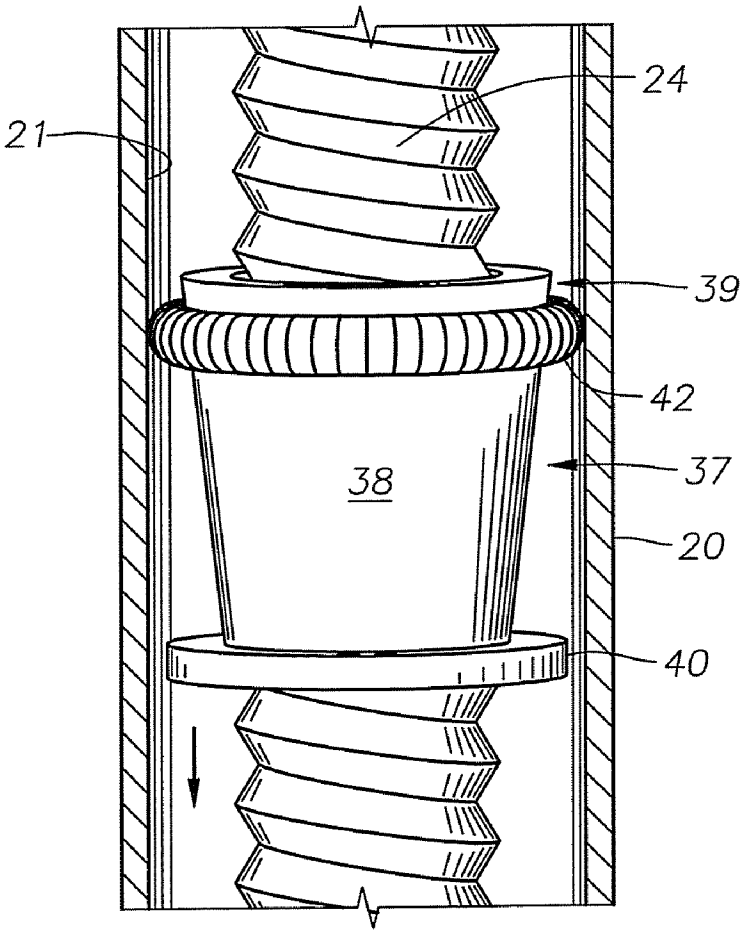
FIG. 7 is a side view of the cable support and cable of FIG. 6 shown inverted.

FIG. 7 illustrates an embodiment of the sliding support 37 and the cable 24 in tubing 20 assembly after being redeployed into a well in an inverted configuration, as in FIG. 4. Thus the flange portion 40 is on the lower end of the sliding support 37 and the flared end 39 is on the upper end. Because the power cable 24 has already been assembled within the tubing 20, respective axial movement is primarily from gravity acting on the power cable 24. A downward gravitational force on the cable 24, while inverted, initially provides some sliding action of the cable 24 and the attached sliding support 37 with respect to the tubing 20. The outward taper on the tapered end 39 of the sleeve 38 reduces the cross-sectional area between the outer circumference of the sleeve 38 and the inner circumference 21 of the tubing 20. Initially, support 37 moves downward relative to spring 42. Ultimately, this reduced annulus area halts downward movement of support 39 relative to spring 42 as it attempts to slide past the tapered sleeve 38. This locks the spring 42 between the tapered sleeve 38 and the inner circumference 21 of the tubing 20, thereby affixing the cable 24 to the tubing 20. Weight of cable 24 transfers through support 37 and spring 42 to coiled tubing 20.

Figure 8:
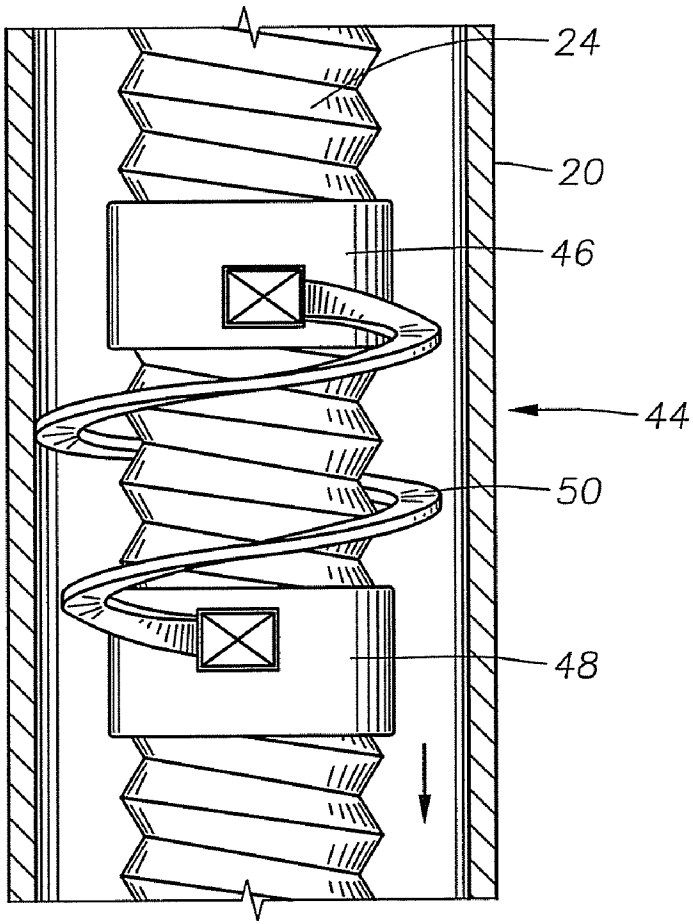
FIG. 8 is a side view of another embodiment of a cable with an attached cable support in tubing.

FIG. 8 provides an alternative embodiment of a sliding support 44 attached to a power cable 24 disposed within tubing 20. In this embodiment, the support 44 comprises a first collar 46 affixed to the power cable 24 to prevent axial or rotational movement of the collar 46 with respect to the power cable 24. A second collar 48, also disposed on the power cable 24, is freely rotatable and axially moveable on the power cable 24. A split C-ring 50 is shown having a first end of the split ring 50 attached to the first collar 46 and a second end attached to the second collar 48. When inserting the power cable 24 into the tubing 20 with the sliding support 44, as in FIG. 2, the second collar 48 is located above the first collar 46, rather than as shown in FIG. 8. This position allows the C-ring 50 to assume a smaller radius and be moved within the tubing 20. Once in an inverted position, as shown in FIG. 8, collar 48 is below fixed collar 46. In this position the ring 50 expands outward and contacts the tubing inner circumference, thereby transferring the cable weight to the tubing 20 and reducing the hanging weight from a hanging point above the area where the support 44 is attached to the cable 24.

Figure 9:
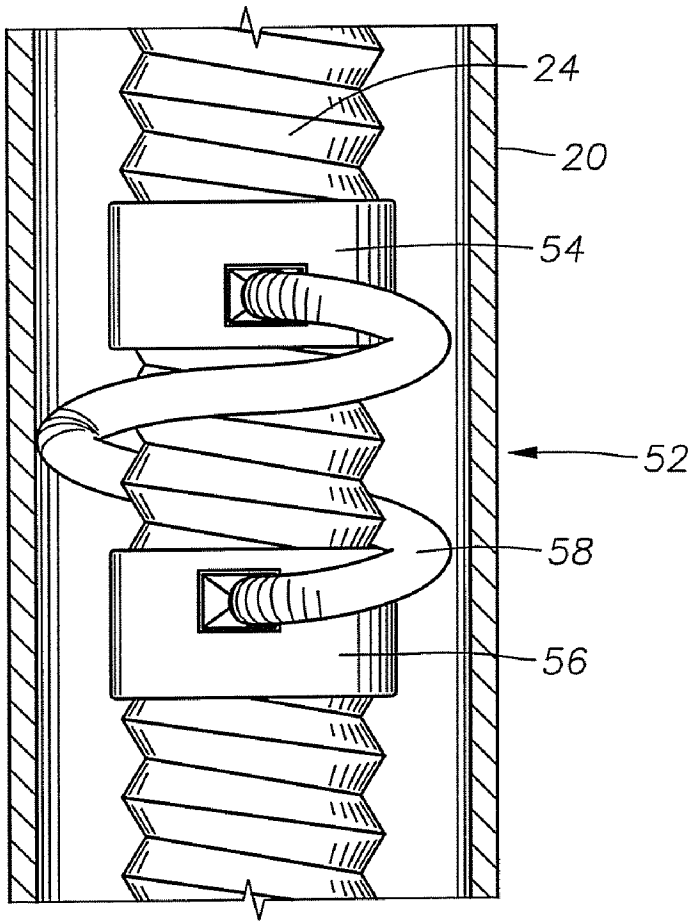
FIG. 9 is a side view of another embodiment of a cable with an attached cable support in tubing.

FIG. 9 is a side partial sectional view of another embodiment, which has support 52 having a fixed collar 54, a sliding rotating second collar 56 and a coiled spring 58 attached on one end to the first collar 54 on the second end to the second collar 56. FIG. 9 shows support 52 in the inverted static position. The operation of the sliding support 52 of FIG. 9 is largely the same as that of the sliding support 44 shown in FIG. 8. It will be inverted from the static position of FIG. 9 while power cable 24 is being inserted into coiled tubing 20.

Figure 11:
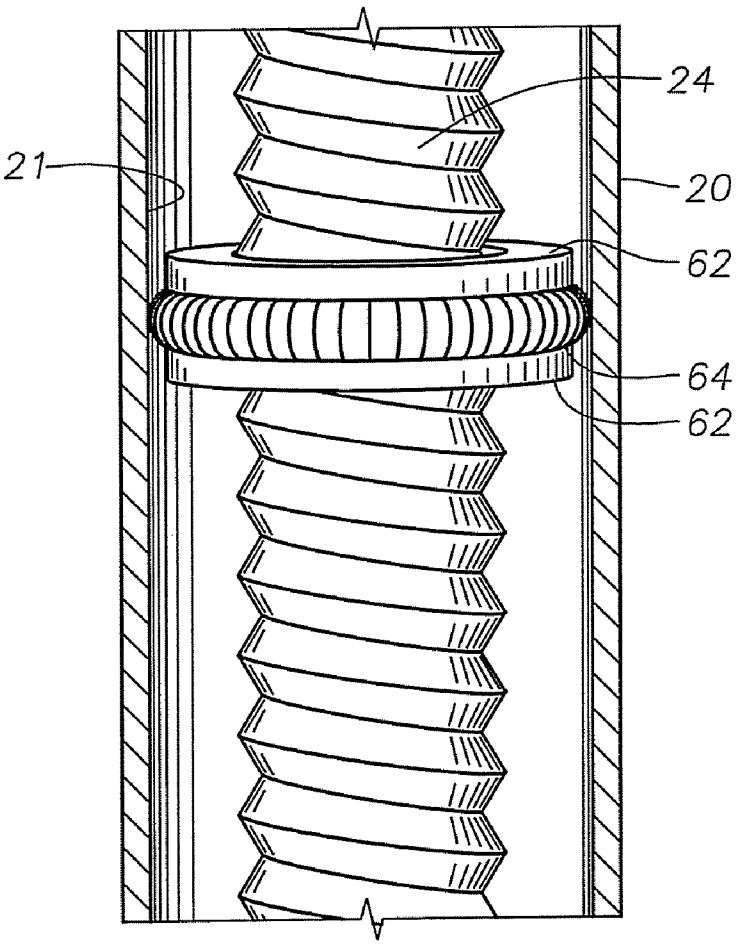
FIG. 11 is a side view of another embodiment of a cable with an attached cable support in tubing.
Figure 10:
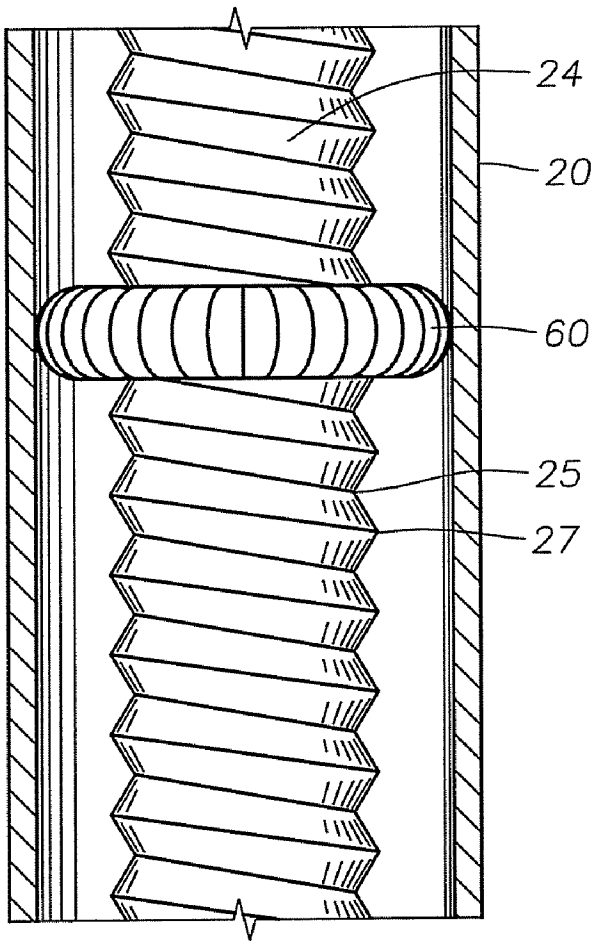
FIG. 10 is a side view of another embodiment of a cable with an attached cable support in tubing.

FIGS. 10 and 11 illustrate embodiments of a sliding support radially disposed at a single location around the cable 24. With reference now to FIG. 10, a side partial sectional view is shown of a coil spring 60 radially circumscribing a power cable 24 and disposed within tubing 20. The spring dimensions may be designed to match the corresponding dimensions of the undulations formed by the troughs 25 and peaks 27 on the cable 24 outer surface. As spring 60 tends to slide over a peak 27, it is further squeezed against coiled tubing 20 and transfers weight. Spring 60 operates in the same manner whether or not inverted. FIG. 11 illustrates an embodiment of a sliding sleeve comprising a collar 62 stationarily affixed to the outer surface of a power cable 24 and in a plane substantially perpendicular to the axis of the power cable 24 and tubing 20. A coil spring 64 is disposed on the outer circumference of the collar 62, wherein the outer radial circumference of the coil spring 64 is in sliding contact with the inner circumference 21 of the tubing 20. As spring 64 tends to roll over the upper flange of collar 62, it is further squeezed against coiled tubing 20 and transfers weight. The embodiment of FIG. 11 operates the same whether or not inverted.

In one example of use, multiple sliding supports are attached to a power cable 24 within a tubing string 20 at intervals determined by the free hanging weight of unsupported power cable 24 length and the frictional attachment of the sliding support 28 to the inner circumference 21 of the tubing 20. As previously noted, the free hanging cable weight must not exceed the tensile strength of the cable. This can be determined by calculating a spacing by which to separate the sliding supports, however, the hanging cable weight should not be reduced to the point wherein the frictional drag of the sliding supports overcomes the gravitational force and/or weight of the cable 24 within the tubing 20. In another example of use, a sliding support is designed to frictionally reduce any subsequent installed cable footage weight to be of no greater than 100 pounds. An additional cable footage or length is installed within the wellbore until a gravity pull of about 500 pounds is realized. At this point, an additional sliding sleeve can be installed onto the cable 24, reducing the gravity weight back to the value of around 100 pounds. Repeating this procedure continues until a preset length of cable 24 is deployed within the coiled tubing 20, thereby "floating" the cable 24 inside the coiled tubing 20 by periodic suspension of the cable 24 with the sliding supports 28. After a power cable 24 is installed in a tubing string 20, the cable 24 gravity weight is at a minimal level, thereby preventing the cable 24 from folding, bending, or otherwise deforming at the bottom of the tubing 20. The cable 24 is thus securely and adequately affixed to the inner circumference 21 of the tubing 20 throughout the cable 24 length to allow the coiled tubing 20 with cable 24 inside to be pulled as a unit from the well. An optional cap (not shown) may be installed on the bottom of the assembly of the cable 24 and coiled tubing 20, thereby preventing the cable 24 to slip beyond the bottom of the coiled tubing 20. Further, optionally, the cable 24 can be secured at the top of the vertical coiled tubing 20, thereby allowing for winding the "cable inside tubing" on a reel 22, thereby having the cable 24 installation inside the tubing 20 complete.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. While the invention has been shown in only one of its forms, it should be apparent to those skilled in the art that it is not so limited but is susceptible to various changes without departing from the scope of the invention.

The invention claimed is:

1. A method of assembling power cable for an electrical submersible pumping (ESP) system with downwardly oriented borehole tubing, the method comprising:

suspending a length of power cable from a hanging point into the downwardly oriented borehole tubing, wherein the length of power cable forms an axial stress in the power cable proximate to the hanging point;

providing a support having an annular body with a portion with a smaller radius and a portion with a larger radius and a resilient member slidably set around the body;

attaching the support to the power cable; and lowering the power cable with attached support into the borehole tubing with the support oriented so that the portion of the body with the larger radius enters the tubing before the smaller radius portion and the resilient member is in sliding frictional contact with an inner surface of the tubing.

2. The method of claim 1, wherein the support comprises a first support, the method further comprising lowering the power cable until the first support is disposed at an interval from the hanging point, attaching a second support to the power cable, the second support configured to be in sliding frictional contact with the borehole tubing inner surface while being lowered into the tubing, and lowering the power cable further into the borehole tubing thereby bringing the second support into sliding frictional contact with the borehole tubing.

3. The method of claim 2, further comprising;

(a) inserting an additional interval of power cable into the borehole tubing, (b) attaching an additional support to the power cable, the additional support configured to be in sliding frictional contact with the borehole tubing inner surface, and (c) repeating steps (a) and (b) until a certain length of power cable is inserted into the borehole tubing.

4. The method of claim 3, wherein the interval of step (a) is constant.

5. The method of claim 3, wherein the interval of step (a) is variable.

6. The method of claim 3, wherein the certain length of power cable is substantially equal to the length of borehole tubing.

7. The method of claim 3, wherein the borehole tubing comprises coiled tubing, the method further comprising retrieving the borehole tubing with inserted power cable from the borehole and spooling the tubing with inserted cable onto a first reel.

8. The method of claim 7 further comprising transferring the tubing with inserted cable from the first reel to a second reel.

9. The method of claim 8 further comprising attaching an ESP system to an end of the tubing, connecting a pump of the ESP to the power cable, and disposing the ESP system with attached tubing and cable from the second reel into a wellbore, wherein disposing the borehole tubing and inserted cable from the second reel into the borehole inverts the power cable and attached supports.

10. The method of claim 9, wherein the supports slide relative to the tubing while the cable is being inserted and do not slide relative to the tubing while the cable and attached supports are inverted.

11. The method of claim 7 further comprising attaching an ESP system to an end of the tubing, connecting a pump motor of the ESP to the power cable, and disposing the ESP system with attached tubing and cable from the first reel into a wellbore.

12. The method of claim 1, wherein the axial stress in the power cable is maintained from about 25% to about 75% of the power cable yield stress.

13. A method of providing an electrical submersible pumping (ESP) system within a borehole having a first end proximate to the surface and a second end disposed in the borehole; the method comprising:

suspending a length of power cable from a hanging point into tubing that is downwardly oriented in the borehole so that the length of power cable forms an axial stress in the power cable proximate to the hanging point;

attaching supports to the power cable that are configured to be in sliding frictional contact with an inner surface of the borehole tubing while being lowered into the tubing;

lowering the power cable with attached supports into the borehole tubing;

retrieving the borehole tubing with power cable suspended therein from the borehole;

inverting the borehole tubing with power cable suspended therein;

attaching an ESP system to an end of the tubing that was downwardly oriented in the borehole, connecting a pump motor of the ESP to the end of the power cable adjacent the end of the tubing that was downwardly oriented in the borehole; and disposing the ESP system with attached tubing and cable into a well, wherein the supports slide relative to the tubing while the cable is being inserted and are substantially stationary relative to the tubing while the cable and attached supports are inverted.

14. A borehole assembly comprising:

tubing disposed in the borehole;

a length of power cable suspended in the tubing; and a suspension support comprising an annular collar circumscribing an amount of power cable with portions of larger and smaller radius and a resilient member circumscribing the collar that is in frictional sliding contact with the tubing inner surface, so that when a force pulls the power cable in a first direction longitudinally within the tubing, the resilient member is positioned to the smaller radius portion to allow the power cable to slide within the tubing, and when a force pulls power cable in a direction opposite the first direction the resilient member is positioned to the larger radius portion and affixes the power cable to the tubing.

15. The borehole assembly of claim 14, wherein the suspension support comprises a first suspension support, the borehole assembly further comprising a second suspension support mounted onto the cable at an interval from the first support, the second suspension support in frictional sliding contact with the tubing inner surface, wherein the power cable has a maximum hanging distance defined by the length of power cable suspended from a hanging point at which the power cable may fracture from a suspended weight of the power cable and wherein the interval value is a percentage of the maximum hanging distance.

16. The borehole assembly of claim 14 wherein the suspension support further comprises a flange on one end and is flared on the other and the resilient member comprises a spring, the spring slidable between the flanged end and the flared end.

17. The borehole assembly of claim 14 wherein the first suspension support comprises a first collar affixed around the cable, a second collar slidable and rotatable on the collar, and a split ring having a first end attached to the first collar and a second end attached to the second collar.

18. The borehole assembly of claim 14 wherein the first suspension support comprises a first collar affixed around the cable, a second collar slidable and rotatable on the collar, and a spring having a first end attached to the first collar and a second end attached to the second collar.

19. The borehole assembly of claim 14 wherein the first suspension support comprises a coil spring circumferentially disposed around the cable.

20. The borehole assembly of claim 19, wherein the first suspension support further comprises a collar between the spring and the cable.

* * * * *